US008839480B2

(12) United States Patent
Thomas

(10) Patent No.: US 8,839,480 B2
(45) Date of Patent: Sep. 23, 2014

(54) EXTEND-A-BRUSH

(76) Inventor: Raimundo Augusto Thomas, Chicago, IL (US)

( * ) Notice: Subject to any disclaimer, the term of this patent is extended or adjusted under 35 U.S.C. 154(b) by 0 days.

(21) Appl. No.: 13/450,156

(22) Filed: Apr. 18, 2012

(65) Prior Publication Data

US 2013/0097796 A1 Apr. 25, 2013

Related U.S. Application Data

(60) Provisional application No. 61/517,260, filed on Apr. 18, 2011.

(51) Int. Cl.

| | |
|---|---|
| ***A46B 17/02*** | (2006.01) |
| ***A46B 17/00*** | (2006.01) |
| ***B25G 1/04*** | (2006.01) |
| ***B25G 1/00*** | (2006.01) |

(52) U.S. Cl.

CPC . *B25G 1/00* (2013.01); *A46B 17/00* (2013.01); *B25G 1/04* (2013.01); *A46B 17/02* (2013.01); *A46B 2200/202* (2013.01)

USPC ..... 15/146; 15/143.1; 15/145

(58) Field of Classification Search

USPC ..... 15/143.1, 145–146, 176.1, 176.6; 16/427, 430; D4/138, 199, 135; 403/221

See application file for complete search history.

(56) References Cited

U.S. PATENT DOCUMENTS

| | | | | |
|---|---|---|---|---|
| 467,046 | A * | 1/1892 | Myers | 15/146 |
| 3,894,807 | A * | 7/1975 | Betz, III | 403/221 |
| 4,134,171 | A | 1/1979 | Love | |
| 4,525,889 | A | 7/1985 | Dunau | |
| 4,854,625 | A | 8/1989 | Eubanks et al. | |
| 5,329,663 | A | 7/1994 | Council | |
| 5,752,287 | A * | 5/1998 | Wheat | 15/176.2 |
| D456,147 | S * | 4/2002 | Anderson | D4/199 |
| 2008/0060158 | A1 | 3/2008 | Douglas et al. | |
| 2010/0017986 | A1 * | 1/2010 | Schiesz et al. | 15/145 |

FOREIGN PATENT DOCUMENTS

| | | | |
|---|---|---|---|
| DE | 3004708 | * | 8/1980 |
| KR | 960004893 | | 4/1996 |

* cited by examiner

*Primary Examiner* — Laura C Guidotti

(74) *Attorney, Agent, or Firm* — J. T. Hollin, Jr., Attorney-at-Law, P.C.

(57) ABSTRACT

Disclosed is a brush holder having a hollow, box-like upper structure with interior contours conformable to the shape of the ferrule and heel of a paintbrush. The lower structure of the brush holder comprises a hollow, primarily longitudinal staff, said staff affixed at its top end to the brush holder. The lower, open end of the staff comprises a circular opening with interior female threads. By use of an extension pole having compatible male threads at one end, a workman, after insertion of a paintbrush into said brush holder, may engage the threads of the brush holder with the threads of the extension pole until a firm and secure attachment is achieved. In this manner, there is provided a greater range of brush contact for applying paint to an otherwise hard-to-reach surface.

8 Claims, 3 Drawing Sheets

EXTEND-A-BRUSH

CROSS-REFERENCES TO RELATED APPLICATIONS

This application claims the benefit of priority of U.S. Provisional Application, Ser. No. 61/517,260, filed on Apr. 18, 2011, and said provisional application is incorporated herein by reference.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

REFERENCE TO A "SEQUENCE LISTING," A TABLE, OR A COMPUTER PROGRAM LISTING APPENDIX

Not applicable.

BACKGROUND OF THE INVENTION (1) Field of the Invention

The disclosed inventive concept relates generally to paint brush holders, and in particular, to the type of brush holder which may be used in combination with an extension pole having male threads at one end of said pole. Normally painters, when painting surfaces of a significant elevation, must use a ladder or scaffold to effectively place an adequate and smooth paint covering, with a brush, to the targeted surface. The use of a ladder has an element of risk and safety concerns, not to mention the inconvenience and time consumption involved in moving the ladder from one position to another.

Although it can be said that the use of a ladder or scaffold, or other vertical extension method, is normally reasonably safe and efficient, it has a number of substantial drawbacks. The brush holder presented herein presents a novel and quick method for use of various sized paint brushes within the confines of the brush holder, thereby aiding the effectiveness of the painting operation.

(2) Description of the Related Art, Including Information Disclosed Under 37 CFR 1.97 and 1.98

In U.S. Pat. No. 4,134,171 (Jan. 16, 1979) there is disclosed a paint brush assembly including a pair of complete, handle-equipped brushes frictionally, but removably held in side-by-side relationship by a tubular holder to provide a unitary, relatively wider bristle brush assembly. The wider brush assembly may be easily separated or disassembled to provide two independently operable paint brushes of relatively narrow widths.

U.S. Pat. No. 4,525,889 (Jul. 2, 1985) is a paint brush holder and length extender including a block supported on a pole. The block includes an opening at its upper end having a resilient spring clip adapted to hold one of a variety of different sized paint brushes at a distance from the painter, thereby making brush changing efficient and rapid and enhancing safety in painting areas which would normally necessitate the use of a ladder. The paint brush may be positioned in a plurality of fixed angles with respect to the pole for ease of working.

U.S. Pat. No. 4,854,625 (Aug. 8, 1989) presents a multipurpose tool holder for holding various tools on an extension handle. The holder includes a flat support plate on the end of the extension handle. The support plate has a cable arrangement such that two cable loops are formed on top of it. The tool to be held is placed through the cable loops, and a wing nut is tightened on a threaded guide bar to tighten the cable securely around the tool. The tool holder may be used in conjunction with paint brushes, scrub brushes, weegies, acid brushes, paint roller frames, and other related tools.

U.S. Pat. No. 5,329,663A (Jul. 19, 1994) discloses a paint brush holder having a threaded opening for receiving a standard threaded extension rod of any desired length. The paint brush holder further includes a unique handle clamp for securely retaining the handle of the paint brush at multiple angles with respect to the received extension rod. By securing the paint brush at the desired angle and attaching the extension rod, a painter is able to access and paint, in a controlled manner, high, hard to reach painting locations such as ceiling corners, edges, moldings and trim.

KR960004893 (Apr. 17, 1996) is an invention pertaining to a paint brush bristle holder which facilitates cleaning after use, and prevents dried paint bristle buildup, and bristle spread. The holder comprises: removable means for fitting over the bristles of the paint brush at the location where the bristles meet the base of the holder and handle of the paint brush, said means preventing the migration of paint into the bristles covered by the removable means.

BRIEF SUMMARY OF THE INVENTION

Essentially, in the preferred embodiment of the inventive concept, a paintbrush is inserted into a brush holder having a hollow, box-like upper structure with interior contours compatible with the shape and size of the paintbrush. The lower structure of the brush holder comprises a hollow, primarily longitudinal staff, said staff affixed at its top end to the brush holder. The other, open end of the staff comprises a circular opening with interior female threads. By use of an extension pole having external male threads at one end, a workman may engage the brush holder with the threads of the extension pole until a firm and secure attachment is achieved. In this manner, there is provided a greater range of contact for applying paint to an otherwise hard-to-reach surface. At the insertion of the paintbrush into the brush holder, the handle of the paintbrush is co-axial with the interior of the staff.

Different embodiments of the inventive concept entail a staff component having a ninety-degree elbow oriented at varying relationships to the upper box-like structure of the brush holder.

BRIEF DESCRIPTION OF THE VIEWS OF THE DRAWINGS

FIG. 1(*a*) is a partial view of the end of an extension pole having male threads.

DETAILED DESCRIPTION OF THE INVENTION

Figure 1:
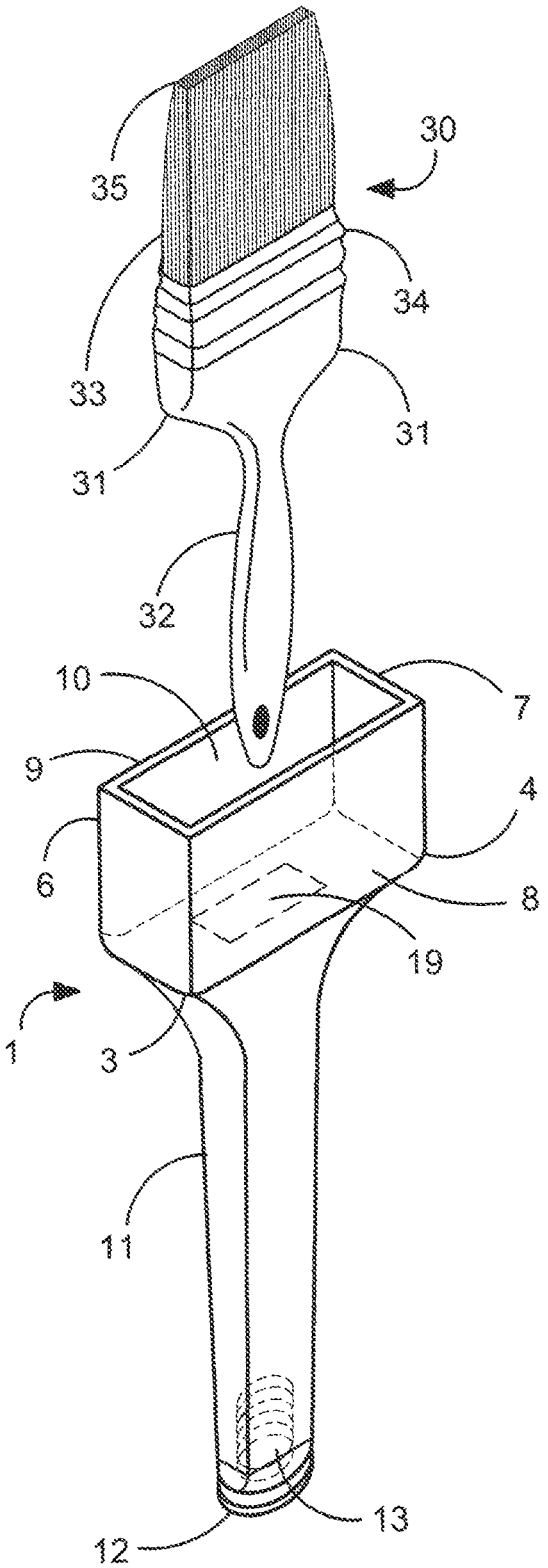
FIG. 1 illustrates a typical paintbrush in the process of being inserted into the upper portion of the brush holder.
Figure 1A:
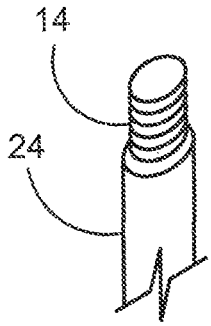

In viewing FIG. 1, there is shown a three-dimensional view of the brush holder 1, which is seen to comprise a box-like upper portion having a back wall 9, a front wall 8, a left side wall 6, a right side wall 7, a rectangular top opening 10, and a handle opening 19. The handle opening 19 is depicted by dash lines. Also shown in FIG. 1 is the lower portion of the brush holder 1, comprising a hollow staff 11, a staff opening 12, and interior female threads 13. The box-like upper portion of the brush holder 1 and the hollow staff 11 are joined together to form one integral structure.

The internal diameter of the staff opening 12 is, in the preferred embodiment, one and one-eighth inch, but may also be of a larger diameter to accommodate a different-sized pole 24 and pole male threads 14. The front wall 8, back wall 9, left side wall 6, and right side wall 7 are optimally ⅛ inch thick, but may be of a greater thickness to provide more rigidity for over-sized brushes. The entire composition of the brush holder 1 comprises a suitable material that may be rigidly flexible or have elastomeric characteristics. Examples of such materials include, but are not limited to vinyl, aluminum, plastic, fiberglass, rubber, or various composite materials.

Further viewing FIG. 1, it can be seen that the brush holder 1 is in position for acceptance of a paintbrush 30. In this preferred embodiment a user must insert the paint brush handle 32 downward into the top opening 10 of the brush holder 1 and on through the handle opening 19. Upon insertion, the paintbrush heels 31 will rest against the interior of the left shoulder 3 and the interior of the right shoulder 4 of the brush holder 1. The ferrule 34 of the paint brush 30 may come into contact with the back wall 9, left side wall 6, right side wall 7, and/or front wall 8 of the brush holder 1. The snugness of such contact will depend on the size of the paint brush 30 and the elasticity of the walls of the brush holder 1.

Once the paint brush 30 is fully inserted into the brush holder 1, the brush bristles 33 and brush toe 35 are free to engage liquid paint and apply the paint to a desired surface, with no encumbrance to the bristles 33 and brush toe 35 back-and-forth motions in the painting process. The handle opening 19, in the preferred embodiment, is a quadrilateral opening of dimensions somewhat smaller than the top opening 10. However, the dimensions of the handle opening 19 are sufficient for acceptance of a brush handle 32 of a paintbrush 30 of size compatible with the inner dimensions of the box-like upper portion of the brush holder 1.

In the preferred embodiment of the inventive concept, after insertion of the paintbrush 30 into the brush holder 1, the brush holder 1 may be attached to an extension pole 24, the end of such a pole being shown in FIG. 1(*a*), wherein the end of the extension pole 24 comprises male threads 14. The brush holder 1 has female threads 13 of compatible manufacturing specifications with the male threads 14 of the extension pole 24. The user of the brush holder 1 proceeds to rotate the threaded end of the extension pole 24 while simultaneously engaging the male threads 14 with the female threads 13 of the brush holder 1. The helical rotation of the matching threads 13, 14 is continued until a firm, secure fastening is accomplished.

The task of painting a surface may also be accomplished by a user, after insertion of a paintbrush 30 into the brush holder 1, grasping the exterior surface of the staff 11 and initiating the painting process. This method may easily be employed in the case of painting a surface that is slightly out of the vertical reach of the painter. For example, an extension pole 24 may not be necessary where the surface to be painted is five inches to ten inches beyond the height normally accessible by using the full length of the paintbrush 30 alone. The combination of the paintbrush 30 and brush holder 1 thereby provides a user with greater reach in such a situation.

Figure 2:
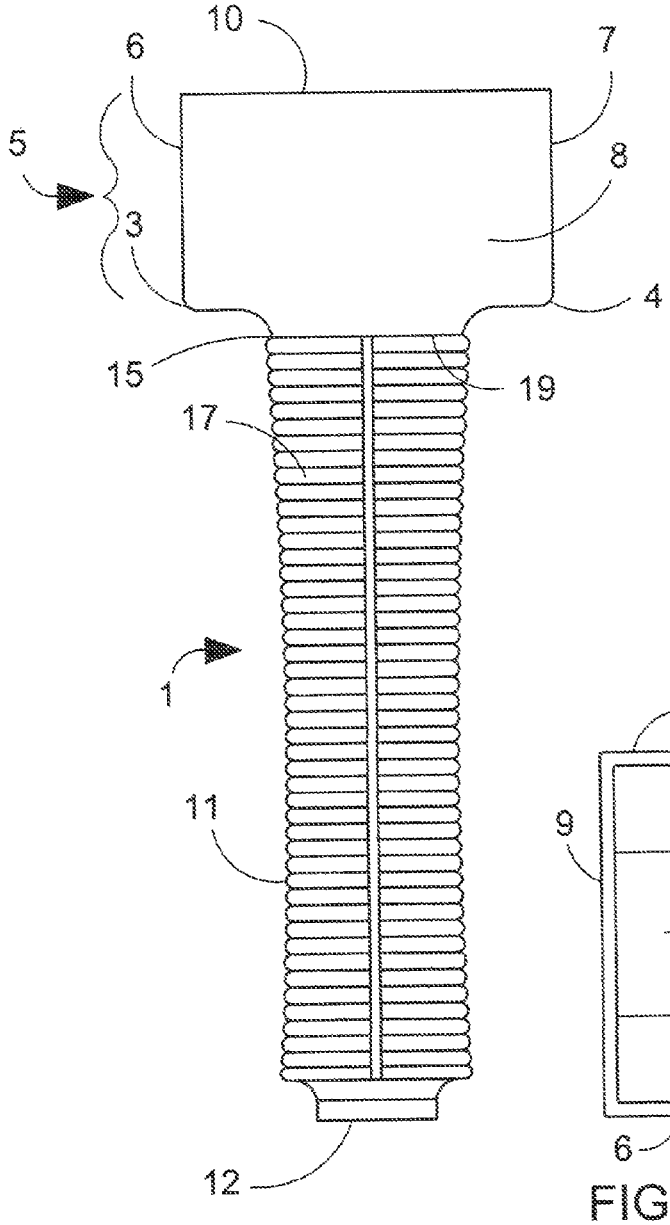
FIG. 2 depicts the front view of a brush holder having an exterior surface comprising tightly-spaced ribbing.

The brush holder 1 is fabricated in a range of sizes, from front wall 8 and back wall 9 dimensions of 1.5 inches to 18.0 inches in width (as measured from the left shoulder 3 to right shoulder 4, and with correspondingly proportionate left and right side walls 6, 7 width and depth 5, as shown in FIG. 2.

Figure 3:
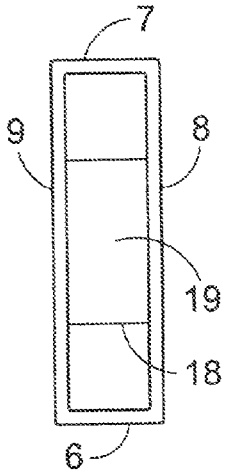
FIG. 3 is a top view of the brush holder of FIG. 2.

In observing FIG. 2, there is shown a front view of the brush holder 1, with the staff 11 having textured exterior surface comprising ribbing 17. Shown in FIG. 2 are the front wall 8, the left and right shoulders 3, 4, the edges of the left and right side walls 6, 7, and the flange 15 which forms the handle opening 19. FIG. 3 illustrates a top view of the brush holder 1 of FIG. 1, wherein there is shown the front and back walls 8, 9, the edges of the left and right side walls 6, 7, a quadrilateral opening 18, and a portion of the interior of the shaft 11, culminating in the staff opening 12.

In viewing FIG. 3, there is displayed a top view of a brush holder 1 having, for a handle opening 19, a quadrilateral opening 18. The quadrilateral opening permits the heels of the paintbrush 31 to engage the interior surfaces of the left and right shoulders 3, 4 while also, when fitted to the appropriately-sized paintbrush 31, enhances the snug fit of the ferrule 34 of the paintbrush against the front and back walls 8, 9, and the left and right sidewalls 6, 7, of the brush holder.

Figure 4:
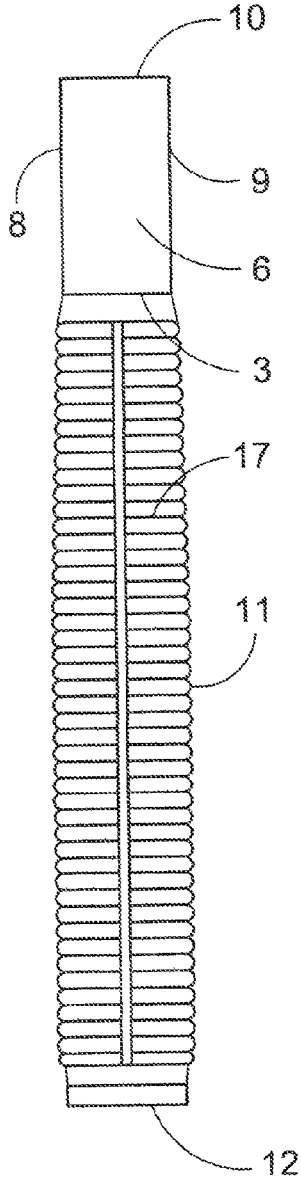
FIG. 4 presents a left-side view of the brush holder of FIG. 2.
Figure 5:
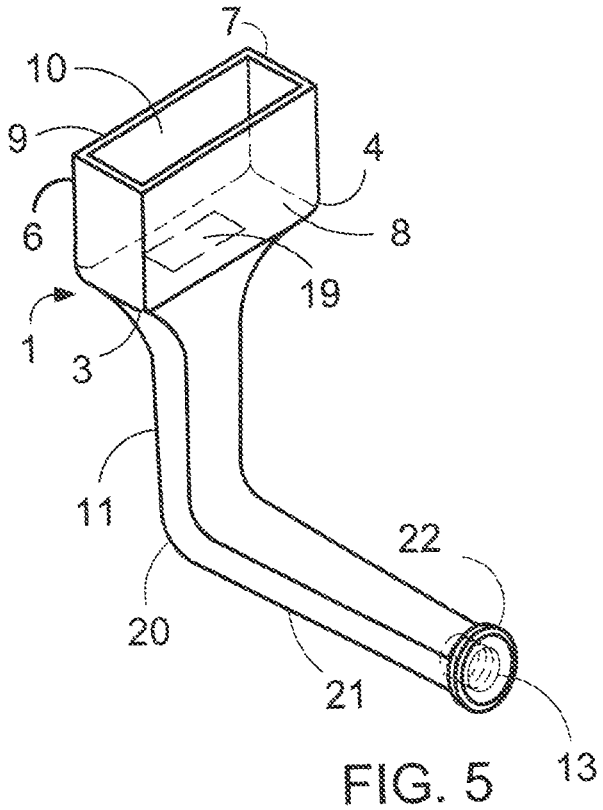
FIG. 5 shows a brush holder having a staff with a ninety-degree elbow which forms a hollow arm oriented perpendicularly to the front wall of the brush holder.

The left profile of the brush holder 1 is illustrated in FIG. 4, further showing the left side wall 6, the right shoulder 3 the flange 15, the staff 11 with an exterior surface of ribbing 17, and the staff opening 12. A different embodiment of the inventive concept, comprising a brush holder 1 fabricated with a staff 11 having an elbow 20 is shown in FIG. 5. The elbow 20 in this embodiment forms an arm 21 with a circular arm opening 22 having female threads 13 that facilitates attachment to an extension pole 24 with one end of said pole 24 having male threads. The arm 21 in this embodiment is oriented perpendicular to the front wall 8 of the brush holder 1 and thereby enables a worker to paint elevated wall surfaces that are normally out of reach of the worker, by primarily using up and down brush strokes.

Figure 6:
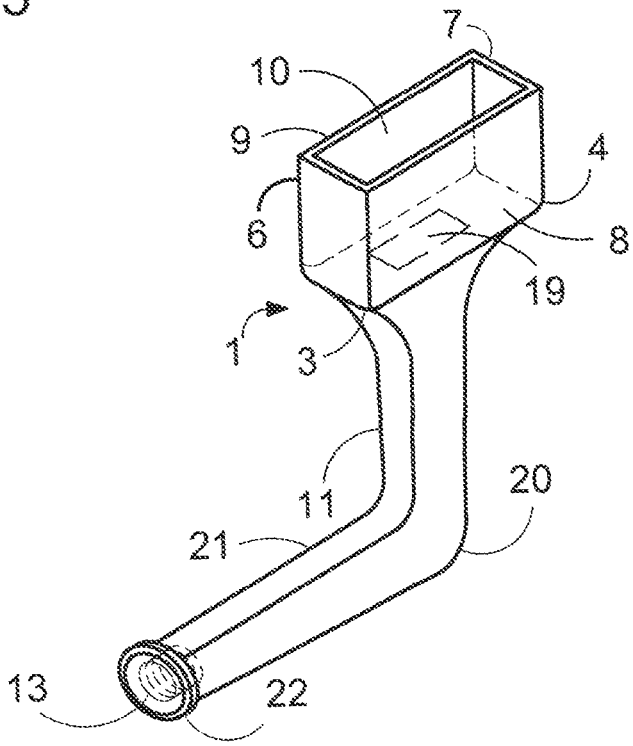
FIG. 6 shows a brush holder having a staff with a ninety-degree elbow which forms a hollow arm oriented parallel to the front wall of the brush holder.

In FIG. 6, another embodiment of the inventive concept, comprises a brush holder 1 fabricated with a staff 11 having an elbow 20 oriented parallel to the front wall 8 of the brush holder 1. The elbow 20 in this embodiment also forms an arm 21 with a circular arm opening 22 having female threads 13 for attachment to a threaded extension pole 24. By virtue of the parallel orientation of the arm 21, a worker is able to paint elevated wall surfaces that are normally out of reach of the worker by primarily using side-to-side brush strokes.

The brush holder 1 is fabricated in a variety of sizes and proportions. The brush holder 1 functions optimally by selecting a brush holder 1 having a box depth 5 and front and back walls 8, 9, width appropriate to the dimensions of the paintbrush 30 to be used.

Figure 7:
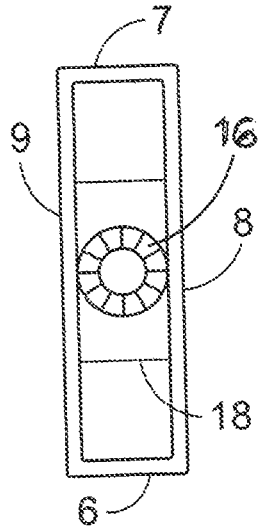
FIG. 7 is a top view of a brush holder having a circular handle opening with closely-spaced elastomeric tabs.

In turning to FIG. 7, there is shown a top view of an embodiment of the brush holder 1 having, instead of a quadrilateral opening 18, a circular elastomeric opening 16. This type of handle opening is fabricated with flexible, closely-spaced tabs arranged around the circumference of the elastomeric opening. Upon insertion of the brush handle 32 into the circular elastomeric opening 16, the elasticity and friction of the tabs provide a gripping strength to keep the paintbrush 30 relatively stable within the confines of the brush holder 1. The circular elastomeric opening 16 is easily fabricated in all embodiments of the brush holder 1, including the preferred embodiment shown in FIG. 1 and the brush holders 1 shown with elbow-enhanced staffs 11 depicted in FIG. 5 and FIG. 6.

While preferred embodiments of the present inventive concept have been shown and disclosed herein, it will be obvious to those persons skilled in the art that such embodiments are presented by way of example only, and not as a limitation to the scope of the inventive concept. Numerous variations, changes, and substitutions may occur or be suggested to those skilled in the art without departing from the intent, scope, and totality of this inventive concept. Such variations, changes, and substitutions may involve other features which are already known per se and which may be used instead of, in combination with, or in addition to features already disclosed herein. Accordingly, it is intended that this inventive concept be inclusive of such variations, changes, and substitutions, and by no means limited by the scope of the claims presented herein.

What is claimed is:

1. A brush holder for use in combination with a paintbrush and a male-threaded extension pole, said brush holder having two integral, joined components comprising:

a first component being, a rectangular-shaped elastomeric box having a wide front wall, a wide back wall, a narrow left side wall, a narrow right side wall, a rectangular top opening, said top opening defined by said front wall, back wall and side walls, and a rectangular bottom end, said bottom end having a handle opening therein in which the handle opening comprises a quadrilateral opening having dimensions sufficient to allow the insertion of a paintbrush handle downward through the box top opening and into the center of said quadrilateral opening, whereupon the heels and ferrule of said paintbrush snugly engage the elastomeric interior walls of the box, thereby providing secure retention of said paintbrush handle within the box; and further, the exterior of said bottom end culminating in a tapered, rectangular flange;

a second component being a hollow staff having (a) an abutting end comprising a rectangular contour of the same dimensions as the rectangular flange of said box bottom end, and (b) an attaching end having a circular opening comprising interior female threads, wherein the rectangular flange of said box and the abutting end of said hollow staff are permanently joined about their perimetral edges so as to form the complete integral brush holder and further, the attaching end of said staff may be rotated so as to engage the external threads of any compatibly-threaded pole.

2. A brush holder as in claim 1, wherein the handle opening at the bottom end of said box comprises a circular opening, said circular opening further comprising elastomeric, segmented tabs, said tabs of sufficient elasticity so as to allow the clutching insertion of a brush handle downward through the box top opening and into the center of said circular opening.

3. A brush holder as in claim 1, wherein the first component comprises a rectangular-shaped rigidly flexible box.

4. A brush holder for use in combination with a paintbrush and a male-threaded extension pole, said brush holder having two integral, joined components comprising:

a first component being a rectangular-shaped elastomeric box having a wide front wall, a wide back wall, a narrow left side wall, a narrow right side wall, a rectangular top opening, said top opening defined by said front wall, back wall and side walls, and a rectangular bottom end, said bottom end having a handle opening therein in which the handle opening comprises a quadrilateral opening having dimensions sufficient to allow the insertion of a paintbrush handle downward through the box top opening and into the center of said quadrilateral opening, whereupon the heels and ferrule of said paintbrush snugly engage the elastomeric interior walls of the box, thereby providing secure retention of said paintbrush handle within the box; and further, the exterior of said bottom end culminating in a tapered, rectangular flange;

a second component being a hollow, bent staff having (a) a ninety-degree elbow forming a staff segment having an axis intersecting, and perpendicular to, the center of said box bottom end an arm segment perpendicular to the from wall of said box, (b) an abutting end comprising a rectangular contour of the same dimensions as the rectangular flange of said box bottom end, and (c) an attaching end at the end of said arm, having a circular opening comprising interior female threads, wherein the rectangular flange of said box and the abutting end of said hollow staff are permanently joined about their perimetral edges so as to form the complete integral brush holder and further, the attaching end of said arm may be rotated so as to engage the external threads of any compatibly-threaded pole.

5. A brush holder as in claim 4, wherein the handle opening at the bottom end of said box comprises a circular opening, said circular opening further comprising elastomeric, segmented tabs, said tabs of sufficient elasticity so as to allow the clutching insertion of a brush handle downward through the box top opening and into the center of said circular opening.

6. A brush holder as in claim 4, wherein the first component comprises a rectangular-shaped rigidly flexible box.

7. A brush holder for use in combination with a paintbrush and a male-threaded extension pole, said brush holder having two integral, joined components comprising:

a first component being a rectangular-shaped elastomeric box having a wide front wall, a wide back wall, a narrow left side wall, a narrow right side wall, a rectangular top opening, said top opening defined by said front wall, back wall and side walls, and a rectangular bottom end, said bottom end having a handle opening therein in which the handle opening comprises a quadrilateral opening having dimensions sufficient to allow the insertion of a paintbrush handle downward through the box top opening and into the center of said quadrilateral opening, whereupon the heels and ferrule of said paintbrush snugly engage the elastomeric interior walls of the box, thereby providing secure retention of said paintbrush handle within the box; and further, the exterior of said bottom end culminating in a tapered, rectangular flange;

a second component being a hollow, bent staff having (a) a ninety-degree elbow forming a staff segment having an axis intersecting, and perpendicular to, the center of said box bottom end an arm segment parallel to the front wall of said box (b) an abutting end comprising a rectangular contour of the same dimensions as the rectangular flange of said box bottom end, and (c) an attaching end at the end of said arm, having a circular opening comprising interior female threads, wherein the rectangular flange of said box and the abutting end of said hollow staff are permanently joined about their perimeteral edges so as to form the complete integral brush holder and further, the attaching end of said arm may be rotated so as to engage the external threads of any compatibly-threaded pole.

8. A brush holder as in claim 7, wherein the handle opening at the bottom end of said box comprises a circular opening, said circular opening further comprising elastomeric, segmented tabs, said tabs of sufficient elasticity so as to allow the clutching insertion of a brush handle downward through the box top opening and into the center of said circular opening.

* * * * *